US009890448B2

(12) United States Patent
Chen et al.

(10) Patent No.: US 9,890,448 B2
(45) Date of Patent: Feb. 13, 2018

(54) AL—ZN—MG ALLOY PRODUCT WITH REDUCED QUENCH SENSITIVITY

(71) Applicant: ALERIS ALUMINUM KOBLENZ GMBH, Koblenz (DE)

(72) Inventors: Shangping Chen, Delft (NL); Linzhong Zhuang, Beverwijk (NL); Sunil Khosla, Beverwijk (NL); Hugo Van Schoonevelt, Noordbeemster (NL); Andrew Norman, Beverwijk (NL); Achim Burger, Hohr Grenzhausen (DE)

(73) Assignee: ALERIS ALUMINUM KOBLENZ GMBH, Koblenz (DE)

( * ) Notice: Subject to any disclaimer, the term of this patent is extended or adjusted under 35 U.S.C. 154(b) by 483 days.

(21) Appl. No.: 14/547,360

(22) Filed: Nov. 19, 2014

(65) Prior Publication Data

US 2015/0068649 A1 Mar. 12, 2015

Related U.S. Application Data

(62) Division of application No. 13/000,189, filed as application No. PCT/EP2009/057306 on Jun. 12, 2009, now abandoned.

(60) Provisional application No. 61/075,360, filed on Jun. 25, 2008.

(30) Foreign Application Priority Data

Jun. 24, 2008 (EP) ..... 08011417

(51) Int. Cl.
*C22F 1/053* (2006.01)
*C22C 21/10* (2006.01)
*C22F 1/00* (2006.01)

(52) U.S. Cl.
CPC ..... *C22F 1/053* (2013.01); *C22C 21/10* (2013.01); *C22F 1/002* (2013.01)

(58) Field of Classification Search
CPC ..... C22C 21/10; C22F 1/053
See application file for complete search history.

(56) References Cited

U.S. PATENT DOCUMENTS

| | | | | |
|---|---|---|---|---|
| 6,027,582 | A | 2/2000 | Shahani et al. | |
| 2002/0121319 | A1 | 9/2002 | Chakrabarti et al. | |
| 2003/0219353 | A1 | 11/2003 | Warner et al. | |
| 2005/0006010 | A1 | 1/2005 | Benedictus et al. | |
| 2005/0034794 | A1 | 2/2005 | Benedictus et al. | |
| 2005/0189044 | A1 | 9/2005 | Benedictus et al. | |
| 2006/0083654 | A1* | 4/2006 | Chakrabarti | B22D 17/2209 420/532 |
| 2006/0096676 | A1 | 5/2006 | Hollrigl et al. | |
| 2008/0173377 | A1 | 7/2008 | Khosla et al. | |
| 2008/0210349 | A1 | 9/2008 | Khosla et al. | |
| 2009/0269608 | A1 | 10/2009 | Benedictus et al. | |
| 2009/0320969 | A1 | 12/2009 | Benedictus et al. | |

FOREIGN PATENT DOCUMENTS

| | | | |
|---|---|---|---|
| CN | 1444665 | A | 9/2003 |
| GB | 1 387 586 | | 3/1975 |
| JP | 10-212538 | A | 8/1998 |
| JP | 11-310840 | A | 11/1999 |
| RU | 2215805 | C2 | 11/2003 |
| RU | 2215808 | C2 | 11/2003 |
| RU | 2243278 | C1 | 12/2004 |
| WO | 02/10466 | A2 | 2/2002 |
| WO | 2004/001080 | A1 | 12/2003 |
| WO | 2004/090183 | A1 | 10/2004 |
| WO | 2004/090185 | A1 | 10/2004 |
| WO | 2007/106772 | A2 | 9/2007 |
| WO | 2008/003504 | A2 | 1/2008 |

OTHER PUBLICATIONS

International Search Report dated Dec. 21, 2009 from corresponding International Application PCT/EP2009/057306.

* cited by examiner

*Primary Examiner* — Roy King
*Assistant Examiner* — Janelle Morillo
(74) *Attorney, Agent, or Firm* — Vorys, Sater, Seymour and Pease LLP

(57) ABSTRACT

This relates to an aluminum alloy product, in particular an age-hardenable Al—Zn—Mg type alloy product for structural members, the alloy product combining a high strength with high toughness and reduced quench sensitivity, and having a chemical composition including, in wt. %: Zn about 3 to 11%, Mg about 1 to 3%, Cu about 0.9 to 3%, Ge about 0.03 to 0.4%, Si max. 0.5%, Fe max. 0.5%, balance aluminum and normal and/or inevitable elements and impurities. Furthermore, this relates to a method of producing such aluminum alloy products.

23 Claims, No Drawings

AL—ZN—MG ALLOY PRODUCT WITH REDUCED QUENCH SENSITIVITY

CROSS-REFERENCE TO RELATED APPLICATIONS

This application is a divisional application of U.S. patent application Ser. No. 13/000,189, filed Jan. 18, 2011, which is a § 371 National Stage Application of International Application No. PCT/EP2009/57306, filed on Jun. 12, 2009, claiming the priority of U.S. Provisional Application No. 61/075,360 filed Jun. 25, 2008 and European Patent Application No. 08011417.6 filed on Jun. 24, 2008, each incorporated herein by reference.

FIELD OF THE INVENTION

The invention relates to an aluminium alloy product, in particular an age-hardenable Al—Zn—Mg type alloy product for structural members, the alloy product combining a high strength with high toughness and reduced quench sensitivity. Furthermore, the invention relates to a method of producing such aluminium alloy products. Products made from this aluminium alloy product are very suitable for aerospace applications, but not limited to that. The alloy can be processed to various product forms, e.g. sheet, thin plate, thick plate, extruded or forged products. More particularly, the invention relates to aluminium alloy products in relatively thick gauges, i.e. about 2 to 12 inches thick. Products made from this Al—Zn—Mg alloy can be used also as a cast product, i.e. as die-cast product.

BACKGROUND OF THE INVENTION

As will be appreciated herein below, except as otherwise indicated, alloy designations and temper designations refer to the Aluminum Association designations in Aluminum Standards and Data and the Registration Records, as published by the Aluminum Association in 2008 as is well known in the art.

For any description of alloy compositions or preferred alloy compositions, all references to percentages are by weight percent unless otherwise indicated.

It is known in the art to use heat treatable aluminium alloys in a number of applications involving relatively high strength, high toughness and corrosion resistance such as aircraft fuselages, vehicular members and other applications. Aluminium alloys AA7050 and AA7150 exhibit high strength in T6-type tempers. The T6 temper is known to enhance the strength of the alloy, wherein the aforementioned AA7050 and AA7x50 alloy products which contain high amounts of zinc, copper and magnesium are known for their high strength-to-weight ratios and, therefore, find application in particular in the aircraft industry. However, these applications result in exposure to a wide variety of climatic conditions necessitating careful control of working and ageing conditions to provide adequate strength and resistance to corrosion, including both stress corrosion and exfoliation. In order to enhance resistance against stress corrosion and exfoliation as well as fracture toughness it is known to artificially over-ageing these 7000-series alloys. When artificially aged to for example a T79, T76, T74 or T73-type temper their resistance to stress corrosion, exfoliation corrosion and fracture toughness improve in the order stated but at some cost to strength compared to the T6 temper condition. An acceptable temper condition is the T74-type temper which is a limited over-aged condition, between T73 and T76, in order to obtain an acceptable level of tensile strength, stress corrosion resistance, exfoliation corrosion resistance and fracture toughness.

However, for thick sectional parts having a thickness of more than about 3 inch or parts machined from such thick sections, a uniform and reliable property balance through thickness is important. Currently, amongst others AA7050 or AA7010 or AA7040 or AA7085 are used for these types of applications. Reduced quench sensitivity, that is deterioration of properties through thickness with lower quenching speed or thicker products, is a major wish from amongst others the aircraft manufactures.

In the production of this type of alloy wrought products these are commonly subjected to a solution heat treatment followed by quenching. In solution heat treating and quenching thick sections, the quench sensitivity of the alloy product is of great concern. After solution heat treating, it is desirable to quickly cool the product for retaining various alloying elements in solid solution rather than allowing them to precipitate out of solution in coarse form as otherwise occurs via slow cooling. The latter occurrence produces coarse precipitates, e.g. $Al_2CuMg$ and/or $Mg_2Zn$, and results in a decline in mechanical properties. In products with thick cross sections, the quenching medium acting on exterior surfaces of such products (either plate, extrusion or forging) cannot efficiently extract heat from the interior including the centre or mid-plane or quarter-plane of that material. This is due to the physical distance to the surface and the fact that heat extracts through the metal by a distance dependent conduction. In thin cross sections (e.g. 2 inch or less), quench rates at the mid-plane are naturally higher than quench rates for a thicker product cross sections. Hence, an alloy product's overall quench sensitivity is often not as important in thinner gauges as it is for thicker gauged products, at least from the standpoint of strength and toughness.

U.S. Pat. No. 6,027,582, forming the basis for the AA7040 development, discloses an optimised balance between alloying elements for improving strength and other properties while avoiding excess additions to minimize quench sensitivity.

US patent application US-2002/0121319-A1, forming the basis for the AA7085 alloy development, discloses another carefully controlled balance of the addition of Zn, Mg and Cu to provide an improved quench sensitivity while maintaining good strength-toughness properties, in particular in thicker gauge aluminium products.

US patent application US-2006/0096676 discloses another controlled 7xxx-series alloy product having high Mg content of 2.6 to 3.0% Mg, a very low Cu-content of 0.10 to 0.2% and a purposive addition of 0.05 to 0.2% Zr to achieve a fine grain structure in the plate product by selecting a combined homogenisation and solution heat treatment with subsequent two-stage cooling to reduce the quench sensitivity in the plate product.

Some other prior art references are:

Japanese patent application JP-10-212538-A discloses a thin gauge aluminium alloy clad product for heat exchangers. The product comprises of an aluminium alloy core layer having an aluminium alloy cladding layer comprises 0.005 to 2.0% of Ge to suppress the formation of oxidized coating on the surface of the sacrificial material in an alkaline environment. The cladding layer preferably further comprises at least 0.1 to 6% Zn, 0.1 to 3.55% Mg. In addition 0.005 to 0.5% of In or Sn may be added as these have a similar effect as Zn. Also V may be added, as well as Si in a range of 0.1 to 0.7% to improve the strength.

International patent application WO-2004/090185 discloses an aluminium alloy product with high strength and fracture toughness and a good corrosion resistance, said alloy comprising essentially, in wt. %: Zn 6.5 to 9.5, Mg 1.2 to 2.2, Cu 1.0 to 1.9, Fe<0.3, Si<0.20, optionally one or more of: (Zr<0.5, Sc<0.7, Cr<0.4, Hf<0.3, Mn<0.8, Ti<0.4, V<0.4), and other impurities or incidental elements and the balance being aluminium. It is disclosed that the alloy may further contain up to 1% silver and up to 1% germanium. However, no examples are given regarding the addition of Ag or Ge, nor is any effect thereof disclosed.

DESCRIPTION OF THE INVENTION

It is an object of the present invention to provide an aluminium-zinc-magnesium-copper alloy product having a reduced quench sensitivity.

It is another object of the invention to provide a method of manufacturing such alloy product.

These and other objects and further advantages are met or exceeded by the present invention concerning an age-hardenable aluminium alloy product in the form of a rolled, extruded or forged product for structural members having a chemical composition comprising, in wt. %:

| | |
|---|---|
| Zn | about 3% to 11% |
| Mg | about 1% to 3% |
| Cu | about 0.9% to 3% |
| Ge | about 0.03% to 0.4% |
| Si | 0 to 0.5% |
| Fe | 0 to 0.5% |
| Ti | at most about 0.3%, |

optionally one or more elements selected from the group consisting of:

Zr at most about 0.5%, preferably 0.03% to 0.25%,
Ti at most about 0.3%, preferably at most 0.1%,
Cr at most about 0.4%
Sc at most about 0.5%
Hf at most about 0.3%
Mn at most about 0.4%, preferably <0.3%,
Ag at most about 0.5%
Li at most about 2.5%, and optionally at most:

about 0.05% Ca
about 0.05% Sr
about 0.004% Be, balance being aluminium and normal and/or inevitable incidental elements and impurities. Typically such elements or impurities are present each <0.05%, total <0.15%.

In accordance with the invention it has been found that the purposive addition of Germanium (Ge) to aluminium-zinc alloy products can significantly decrease the quench sensitivity which permits quenching thicker gauges while still achieving very good combinations of strength-toughness and corrosion resistance performance. This reduced quench sensitivity has been found in particular to occur in thicker gauge aluminium alloy products, i.e. having a thickness more of 2 inch (50 mm) or more. The addition of Ge can be made also to alloy products currently being supplied on a commercial basis for aerospace-type applications, such as AA7050, AA7010, AA7040, AA7081, and AA7085, while maintaining high strength-toughness properties in the alloy products.

The reduced quenched sensitivity allows also for lower cooling rate when producing the alloy products. Lower cooling rates would introduce less residual stresses in the alloy product, in turn resulting in less distortion in machined products. This would make the alloy product a good candidate for specific aerospace applications where machining tolerances are critical and for application such as tooling plate.

A more preferred lower limit for the Ge addition is about 0.05%, and more preferably about 0.08%. At too low levels no effect of the addition of Ge on the quench sensitivity has been found. The Ge addition should not exceed 0.4%, and a more preferred upper limit for the Ge addition is about 0.35%. The Ge addition should not be too high because a too high level of Ge contributes to the formation of eutectic phases, i.e. Ge—Si eutectic phase, which have a lower melting temperature and may adversely effect amongst others the toughness of the alloy product. Although not yet fully understood the addition of Ge retards the precipitation on cooling of the alloy product from a high temperature.

In a preferred embodiment of the alloy product according to this invention it has a lower limit for the Zn-content of about 6.1%, and preferably of about 6.4%. And a more preferred upper limit for the Zn content is about 8.5%, and more preferably about 8.1%.

In a preferred embodiment, the alloy product according to this invention has a preferred upper limit for the Mg content of about 2.5%, and preferably about 2.0%, and more preferably of about 1.9%. A too high Mg content has an adverse effect on the toughness of the alloy product.

In a preferred embodiment, the alloy product according to this invention has a lower limit for the Cu-content of about 0.9% and more preferably about 1.1%. It has been found that AA7xxx-series alloys having a low Cu-content, for example AA7021, did not show any noticeable effect on the quench sensitivity when adding Ge in the claimed ranges. In a preferred embodiment the upper limit for the Cu content is about 2.6%, preferably about 2.2%, and more preferably about 2%.

In a preferred embodiment of the alloy product the leaner composition with respect to the addition of Zn, Mg, and Cu (thus preferably less than 8.1% Zn, less than 2.5% Mg, and less than 2.6% Cu) are being preferred as this will assist in bringing more Ge is solid solution to obtain an optimum in the favourably reduced quench sensitivity.

The Fe content for the alloy product should be less than 0.5%, and preferably less than about 0.35%. When the alloy product is used for aerospace application preferably the lower-end of this range is preferred, e.g. less than about 0.1%, and more preferably less than about 0.08% in order to maintain in particular the toughness at a sufficiently high level. Where the alloy product is used for tooling plate application, a higher Fe content can be tolerated. However, it is believed that also for aerospace application a moderate Fe content, for example about 0.09% to 0.13%, or even about 0.10% to 0.15%, can be used.

The Si content for the alloy product should be less than 0.5%, and preferably less than about 0.35%. When the alloy product is used for aerospace application preferably the lower-end of this range is preferred, e.g. less than about 0.1%, and more preferably less than about 0.08% in order to maintain in particular the toughness at a sufficiently high level. Where the alloy product is used for tooling plate application, a higher Si content can be tolerated. However, it is believed that with dedicated heat treatments also higher Si levels can be tolerated also for aerospace applications. A preferred upper limit for the Si level is about 0.25%. Dedicated heat treatments are for example those disclosed in international patent application WO-2008/003504, incorporated herein in its entirety by reference.

Silver in a range of at most about 0.5% can be added to further enhance the strength during ageing. A preferred lower limit for the Ag addition would be about 0.03% and more preferably about 0.08%. A preferred upper limit would be about 0.4%.

Li in a range of at most about 2.5% can be added the alloy product to further enhance the age hardening effect in the alloy product to increase strength after ageing of the alloy product. A further advantage of the addition of Li is to increase of the modulus aluminium alloy product.

Each of the dispersoid forming elements Zr, Sc, Hf, V, Cr, and Mn can be added to control the grain structure and to further control the quench sensitivity. The optimum levels of dispersoid formers depend on the processing, but when one single chemistry of main elements (Zn, Mg, and Cu) is chosen within the preferred window and that chemistry will be used for all relevant products forms, then Zr levels are less than about 0.5%.

A preferred maximum for the Zr level is about 0.25%. A suitable range of the Zr level is about 0.03% to 0.2%. A more preferred upper-limit for the Zr addition is about 0.15%. Zr is a preferred alloying element in the alloy product according to this invention. Although Zr can be added in combination with Mn, for thicker gauge products it is preferred that when Zr is added that any addition of Mn is avoided, preferably by keeping Mn at a level of less than 0.03%. In thicker gauge product the Mn phases coarsens more rapid than the Zr phases, thereby adversely affecting the quench sensitivity of the alloy product.

The addition of Sc is preferably not more than about 0.5% or more preferably not more than 0.3%, and even more preferably not more than about 0.18%. When combined with Sc, the sum of Sc+Zr should be less then 0.3%, preferably less than 0.2%, and more preferably a maximum of about 0.17%.

Another dispersoid former that can be added, alone or with other dispersoid formers is Cr. Cr levels should preferably be below about 0.4%, and more preferably a maximum of about 0.3%, and even more preferably about 0.2%. A preferred lower limit for the Cr would be about 0.04%. Where is the prior art the addition of Cr to 7xxx-series aluminium alloy was considered to make these alloy products more quench sensitive, and for which reason the addition of Zr is currently being preferred for many alloy products, in accordance with the present invention the purposive addition of Ge makes the Cr-containing alloy product less quench sensitive and renders them attractive to various structural applications. Although Cr alone may not be as effective as solely Zr, at least for use in tooling plate of the alloy product, similar hardness results may be obtained. When combined with Zr, the sum of Zr +Cr should not be above about 0.23%, and preferably not more than about 0.18%.

The preferred sum of Sc+Zr+Cr should not be above about 0.4%, and more preferably not more than 0.27%.

In another embodiment of the aluminium alloy product according to the invention the alloy product is free of Cr, in practical terms this would mean that the Cr content is at regular impurity levels of <0.05%, and preferably <0.03%, and more preferably the alloy is essentially free or substantially free from Cr. With "substantially free" and "essentially free" we mean that no purposeful addition of this alloying element was made to the composition, but that due to impurities and/or leaching from contact with manufacturing equipment, trace quantities of this element may, nevertheless, find their way into the final alloy product. In particular for thicker gauge products (e.g. more than 3 mm) the Cr ties up some of the Mg to form $Al_{12}Mg_2Cr$ particles which adversely affect quench sensitivity of the alloy product, and may form coarse particles at the grain boundaries thereby adversely affecting the damage tolerance properties.

Mn can be added as a single dispersoid former or in combination with one of the other dispersoid formers. A maximum for the Mn addition is about 0.4%. A suitable range for the Mn addition is in the range of about 0.05% to 0.4%, and preferably in the range of about 0.05% to 0.3%. A preferred lower limit for the Mn addition is about 0.12%. When combined with Zr, the sum of Mn plus Zr should be less then about 0.4%, preferably less than about 0.32%, and a suitable minimum is about 0.12%.

In another embodiment of the aluminium alloy product according to the invention the alloy is free of Mn, in practical terms this would mean that the Mn-content is <0.03%, and preferably <0.02%, and more preferably the alloy is essentially free or substantially free from Mn. With "substantially free" and "essentially free" we mean that no purposeful addition of this alloying element was made to the composition, but that due to impurities and/or leaching from contact with manufacturing equipment, trace quantities of this element may, nevertheless, find their way into the final alloy product.

In another preferred embodiment of the aluminium alloy product according to this invention the alloy has no deliberate addition of V such that it is only present, if present, at regular impurity levels of less than 0.05%, preferably less than 0.02%.

Ti can be added to the alloy product amongst others for grain refiner purposes during casting of the alloy stock, e.g. ingots or billets. The addition of Ti should not exceed about 0.3%, and preferably it should not exceed about 0.1%. A preferred lower limit for the Ti addition is about 0.01%. Ti can be added as a sole element or with either boron or carbon serving as a casting aid, for grain size control.

Traditionally, beryllium additions have served as a deoxidizer/ingot cracking deterrent and may be used in the alloy product according to this invention. Though for environmental, health and safety reasons, more preferred embodiments of this invention are substantially Be-free. Minor amounts of Ca and Sr alone or in combination can be added to the alloy product for the same purposes as Be. Preferred addition of Ca is in a range of about 10 to 100 ppm.

The balance in the alloy product is made by aluminium and normal and/or inevitable incidental elements and impurities. Typically such elements or impurities are present at a level of each <0.05%, total <0.15%.

In another embodiment, the alloy product according to this invention has a chemical composition within the ranges of AA7010, AA7040, AA7140, AA7050, AA7055, AA7075, AA7081, or AA7085, plus modifications thereof, combined with the purposive addition of Ge according to this invention.

The alloy product is in the form of a rolled, extruded or forged product, and more preferably the product is in the form of a sheet, plate, forging or extrusion, ideally as part of an aircraft structural part. Such aircraft structural parts would include amongst others fuselage sheet, fuselage frame member, upper wing plate, lower wing plate, thick plate for machined parts, forging or sheet for stringers, spar member, rib member, floor beam member, and bulkhead member.

In addition, non-aerospace parts can be made according to this invention, e.g. as tooling plate for moulds for manufacturing formed plastic or rubber products via for example die-casting or injection moulding.

Good combinations of properties are desired in all thicknesses, but they are particularly useful in thickness ranges where, conventionally, as the thickness increases, quench sensitivity of the product also increases. Hence, the alloy product of this invention finds particular utility in thick gauges of, for example, greater than 2 inches (50 mm) to 3 inches (76 mm) in thickness up to 12 inches (305 mm) or more.

Although the primary focus of this invention was on thick cross sectioned alloy products quenched as rapidly as practical, those skilled in the art will recognise that another application hereof would be to take advantage of the low quench sensitivity and use an intentionally slow quench rate on thin sectioned alloy parts to reduce the quench-induced residual stresses therein, and the amount of distortion brought on by rapid quenching but without significantly sacrificing strength and/or toughness.

In a further aspect of the invention it relates to a method of manufacturing a wrought aluminium alloy product of an AA7000-series alloy, the method comprising the steps of:

a. casting stock of an ingot or billet of an AlZnMg(Cu) Ge-alloy according to this invention;
b. preheating and/or homogenising the cast stock;
c. hot working the stock by one or more methods selected from the group consisting of rolling, extrusion, and forging;
d. optionally cold working the hot worked stock;
e. solution heat treating (SHT) of the hot worked and optionally cold work stock;
f. cooling said SHT stock;
g. optionally stretching or compressing the cooled SHT stock or otherwise cold working the cooled SHT stock to relieve stresses, for example levelling or drawing or cold rolling of the cooled SHT stock,
h. ageing of the cooled and optionally stretched or compressed or otherwise cold worked SHT stock to achieve a desired temper.

The aluminium alloy can be provided as an ingot or slab or billet for fabrication into a suitable wrought product by casting techniques regular in the art for cast products, e.g. DC-casting, EMC-casting, EMS-casting. Slabs resulting from continuous casting, e.g. belt casters or roll casters, also may be used, which in particular may be advantageous when producing thinner gauge end products. After casting the alloy stock, the ingot is commonly scalped to remove segregation zones near the cast surface of the ingot.

The purpose of a homogenisation heat treatment has the following objectives: (i) to dissolve as much as possible coarse soluble phases formed during solidification, and (ii) to reduce concentration gradients to facilitate the dissolution step. A preheat treatment achieves also some of these objectives. A typical preheat treatment would be a temperature of 420° C. to 460° C. with a soaking time in the range of 3 to 50 hours, more typically for 3 to 24 hours. It is important that the soluble eutectic phases such as the S-phase, T-phase, and M-phase in the alloy product are dissolved. This is typically carried out by heating the stock to a temperature of less than 500° C., and typically in a range of 440° C. to 485° C., as the S-phase eutectic phase ($Al_2MgCu$-phase) has a melting temperature of about 489° C. in AA7000-series alloys and the M-phase ($MgZn_2$-phase) has a melting point of about 478° C. As is known in the art this can be achieved by a homogenisation treatment in said temperature range and allowing the stock to cool to the hot working temperature, or after homogenisation the stock is subsequently cooled and reheated to hot working temperature. The homogenisation process can also be done in two or more steps if desired, and which are typically carried out in a temperature range of 430° C. to 490° C. for alloy products according to this invention. For example in a two step process, there is a first step between 445° C. and 455° C., and a second step between 460° C. and 485° C., to optimise the dissolving process of the various phases depending on the exact alloy composition.

The soaking time at the homogenisation temperature is alloy dependent as is well known to the skilled person, and is commonly in the range of about 1 to 50 hours. The heat-up rates that can be applied are those which are regular in the art.

In dependence of the Ge and Si content present in the alloy product, and in particular for levels of about 0.1% or more, it might be advantageous that the homogenisation practice comprises a further step at a somewhat higher temperature, for example at a temperature in a range of more than 500° C. but at a temperature lower than the solidus temperature of the subject alloy in order to dissolve as much as possible all Ge and Si-phases present. For the alloy product according to this invention the preferred temperature is in a range of >500° C. to 550° C., preferably 505 to 540° C., and more preferably 510 to 535° C. For the alloy system according to this invention the soaking time at this somewhat higher temperature is from about 1 to up about 50 hours. A more practical soaking time would not be more than about 30 hours. A too long soaking time may lead to an undesired coarsening of dispersoids adversely affecting the mechanical properties of the final alloy product.

Following the preheat and/or homogenisation practice the stock can be hot worked by one or more methods selected from the group consisting of rolling, extrusion, and forging, preferably using regular industry practice. The method of hot rolling is preferred for the present invention.

The hot working, and hot rolling in particular, may be performed to a final gauge, e.g. 0.125 inch (3 mm) or less or alternatively thick gauge products, i.e. in a range of 2 inch (50 mm) or more, for example up to 12 inch (305 mm) or more, for example in a range of 3 inch (76 mm) to 9 inch (223 mm) Alternatively, the hot working step can be performed to provide stock at intermediate gauge, typical sheet or thin plate. Thereafter, this stock at intermediate gauge can be cold worked, e.g. by means of rolling, to a final gauge. Depending on the alloy composition and the amount of cold work an intermediate anneal may be used before or during the cold working operation.

The cold worked and optionally cold worked alloy product is subjected to a solution heat treatment ("SHT") at a temperature and time sufficient to place as much as possible into solid solution substantially all soluble constituents, including any of the possible $Mg_2Si$-phases and Ge-containing phases which may have precipitated out during cooling from the homogenisation treatment or the during a hot working operation or any other intermediate thermal treatment of the alloy, followed by fast cooling for the subject aluminium alloy product. The SHT is preferably carried out in the same temperature range and time range as the homogenisation treatment as set out in this description, together with the preferred narrower ranges. However, it is believed that also shorter soaking times can still be very useful, for example in the range of about 2 to 180 minutes. The solution heat treatment is typically carried out in a batch furnace, but can also be carried out in a continuous fashion.

After SHT, it is important that the aluminium alloy be cooled to a temperature of about 150° C. or lower, preferably to ambient temperature, to prevent or minimise the uncontrolled precipitation of secondary phases, e.g. $Al_2CuMg$ and/or $Mg_2Zn$. On the other hand cooling rates should preferably not be too high in order to allow for a sufficient flatness and low level of residual stresses in the product. Suitable cooling rates can be achieved with the use of water, e.g. water immersion or water jets. The reduced or low quench sensitivity of the alloy products according to this invention is of extreme importance. In thicker gauges, the less quench sensitivity the better with respect to that alloy product's ability to retain alloying elements in solid solution (thus avoiding the formation of adverse precipitates, coarse and others, upon slow cooling from SHT temperatures) particularly in the more slowly cooling mid- and quarter-plane regions of such thick alloy products.

The stock may be further cold worked, for example, by stretching in the range of about 0.5% to 8% of its original length to relieve residual stresses therein and to improve the flatness of the product. Preferably the stretching is in the range of about 0.5% to 6%, more preferably of about 0.5% to 5%.

After cooling the stock is aged, typically at ambient temperatures, and/or alternatively the stock can be artificially aged. All ageing practices known in the art and those which may be subsequently developed can be applied to the AA7000-series alloy products obtained by the method according to this invention to develop the required strength and other engineering properties. For example T6 and T7x temper conditions, obtained by one stage, two stage, or three stage artificial ageing practices, or alternatively a non-isothermal ageing practice as disclosed in international patent application WO-2007/106772-A2 can be applied.

A desired structural shape can then be machined from the heat treated plate sections, more often generally after artificial ageing, for example, an integral wing spar. Similar SHT, quench, often stress relief operations and artificial ageing are also followed in the manufacture of thick sections made by extrusion and/or forged processing steps.

The low quench sensitivity of the alloy product according to this invention can offer another embodiment of manufacturing wrought aluminium alloy products, wherein the alloy product is being hot formed by means of extrusion and press quenched. "Press quenching" is known by those skilled in the art as a process involving controlling the extrusion temperature and other extrusion conditions such that upon exiting the extrusion die, the part is at or near the desired solution heating temperature and the soluble constituents are effectively brought to solid solution. It is then immediately and directly continuously quenched as the part exits the extrusion press by either water, pressurised air or other media. The press quenched part can then go through the usual stretching, followed by either natural or artificial ageing. Hence, a costly separate solution heat treating process is eliminated from this favourable press quenching variation, thereby significantly lowering overall manufacturing costs, and energy consumption as well. Since the alloy product has very low quench sensitivity, it is expected that the property degradation during press quenching is either eliminated or significantly reduced to acceptable levels for many applications.

In another embodiment the alloy product according to this invention is provided as an aluminium casting or aluminium foundry alloy product, typically produced via sand casting, permanent mould casting or die-casting. In this embodiment the aluminium casting is preferably provided in a T5, T6 or T7 temper. A T5 temper concerns a temper wherein after extracting from the die the product is immediately quenched, e.g. in water, and then artificially aged. A T6 temper concerns a temper wherein the product is SHT, quenched and artificially aged to maximum or near maximum strength. A T7 temper concerns a temper wherein the product is SHT, quenched and stabilised or aged beyond the point of maximum strength.

The aluminium cast product according to this invention can be used for automotive and aerospace applications, in particular applications requiring considerable load-bearing capabilities.

In a further aspect there is provided a method of producing cast product according to this invention comprises the steps of:

a. preparing an aluminium alloy melt of an AlZnMg(Cu) Ge-alloy composition according to this invention,
b. casting at least a portion of the melt in a mould configured to form the casting, preferably by means of sand, permanent mould or die-casting, and
c. removing the casting from the mould.

In an embodiment of the casting method it further comprises subjecting the casting to an ageing treatment, preferably an artificial ageing treatment, and preferably to a SHT and cooling prior to the ageing treatment. Mechanical deformation is not required to benefit from the reduced quench sensitivity found in accordance with this invention. More important is that Ge is brought into solution either during the casting operation or combination with subsequent a solution heat treatment.

It has been found that when used as a cast product the Fe content in the alloy product can be tolerated to even higher levels of up to about 0.6% as is practiced on a commercial basis in 7xx-series foundry alloys, while still benefiting from the reduced quench sensitivity in accordance with this invention.

In the following, the invention will be explained by the following non-limitative examples.

EXAMPLES

Example 1

Three aluminium alloys have been cast having compositions as listed in Table 1, and wherein alloy 1 is according to the prior art and alloys 2 and 3 are according to this invention. A regular Ti-C grain refiner was used. Blocks were machined having dimensions of 300 by 80 mm. Each block was homogenised by soaking it for 12 hours at 455° C., then by 24 hours at 460° C., followed by 24 hours at 530° C., and cooled to room temperature. Prior to hot rolling the blocks were preheated to 450° C., and subsequently hot rolled from a gauge of 80 mm to 40 mm. Hot rolled sample bars were solution heat treated at 470° C. for 1 hour and then quenched at different cooling rates, viz. by means of quenching into water ("WQ") and by cooling in a furnace resulting in a cooling rate of about 1-3° C./min ("FC"). 24 hours after being cooled to ambient temperature and representing a T4-type condition the hardness (HB 62.5/2.5) had been measured in all sample bars and the electrical conductivity (IACS). The results of the hardness measurements and the conductivity are being listed in Table 2. Thereafter the sample bars had been brought to a T6 condition by holding the bars for 12 hours at 135° C. followed by quenching in water. Again the hardness had been measured in all sample bars and the results are presented in Table 2 also.

TABLE 1

Chemical composition (in wt. %) of the alloy tested, balance aluminium and unavoidable and regular impurities.

| | Element | | | | | | | |
|---|---|---|---|---|---|---|---|---|
| Alloy | Zn | Mg | Cu | Fe | Mn | Si | Ge | Zr |
| 1 | 7.5 | 1.4 | 1.45 | 0.04 | 0.06 | 0.03 | — | 0.1 |
| 2 | 7.5 | 1.4 | 1.45 | 0.05 | 0.06 | 0.14 | 0.32 | 0.1 |
| 3 | 7.5 | 1.4 | 1.44 | 0.05 | 0.06 | 0.04 | 0.32 | 0.1 |

TABLE 2

Hardness and conductivity in the T4 and T6 condition as function of the cooling rate applied after SHT.

| | Cooling method | T4 condition | | T6 condition |
|---|---|---|---|---|
| Alloy | after SHT | hardness | conductivity | hardness |
| 1 | WQ | 95 | 32.51 | 159 |
| 1 | FC | 65 | 42.26 | 75 |
| 2 | WQ | 89 | 33.72 | 149 |
| 2 | FC | 72 | 40.66 | 85 |
| 3 | WQ | 93 | 33.20 | 162 |
| 3 | FC | 91 | 38.88 | 113 |

From the results of Table 2 it can be seen that the lower conductivity in the T4 temper for the FC-cooled samples having a purposive addition of Ge (alloys 2 and 3) indicates that more elements are in solid solution. Furthermore, the increased hardness of alloys 2 and 3 compared to alloy 1 for the FC-cooled samples indicates a significantly reduced quench sensitivity. The effect of the Ge addition on the hardness in FC-cooled samples can be found both in the T4 and the T6 condition.

The reduced or lower quench sensitivity of the alloy products according to this invention is of extreme importance. In thicker gauges, the less quench sensitivity the better with respect to that alloy product's ability to retain alloying elements in solid solution (thus avoiding the formation of adverse precipitates, coarse and others, upon slow cooling from SHT temperatures) particularly in the more slowly cooling mid- and quarter-plane regions of such thick alloy products.

Having now fully described the invention, it will be apparent to one of ordinary skill in the art that many changes and modifications can be made without departing from the spirit or scope of the invention as herein described.

The invention claimed is:

1. A method of manufacturing a wrought aluminium alloy product of an AA7000-series alloy, the method comprising the steps of:

a. casting stock of an ingot of an AA7000-series aluminium alloy comprising an aluminium alloy having a chemical composition comprising, in wt. %:

| | |
|---|---|
| Zn | 3% to 11%, |
| Mg | 1% to 3%, |
| Cu | 0.9% to 3%, |
| Ge | 0.08% to 0.4%, |
| Si | maximum 0.5%, |
| Fe | maximum 0.5%, |
| Ti | maximum 0.5%, |

optionally one or more elements selected from the group consisting of:

| | |
|---|---|
| Mn | at most 0.4%, |
| Ti | at most 0.3%, |
| Cr | at most 0.4%, |
| Zr | at most 0.5%, |
| Sc | at most 0.5%, |
| Hf | at most 0.3%, |
| V | at most 0.4%, |
| Ag | at most 0.5%, |
| Li | at most 2.5%, |

and optionally at most:

about 0.05% Ca, about 0.05% Sr, about 0.004% Be, balance aluminium and normal and/or inevitable elements and impurities, said normal and/or inevitable elements and impurities being present each <0.05%, total <0.15%;

b. homogenising the cast stock by heating the stock to a temperature in a range of 430 to 490° C., followed by heating to a temperature in a range of >500° C. to 550° C.;

c. hot working the stock by one or more methods selected from the group consisting of rolling, extrusion, and forging;

d. optionally cold working the hot worked stock;

e. solution heat treating (SHT) of the hot worked stock and optionally cold worked stock;

f. cooling the SHT stock at a cooling rate of about 1-3° C. per minute to 150° C. or lower;

g. optionally stretching or compressing the cooled SHT stock or otherwise cold working the cooled SHT stock to relieve stresses;

h. ageing of the cooled and optionally stretched or compressed or otherwise cold worked SHT stock to achieve a desired temper.

2. The method according to claim 1, wherein the alloy further comprises one or more elements selected from the group consisting of:

| | |
|---|---|
| Mn | at most 0.4%, |
| Cr | at most 0.4%, and |
| Zr | at most 0.5%. |

3. The method according to claim 1, wherein the alloy product has a Zr content in a range of 0.03% to 0.5%.

4. The method according to claim 1, wherein the alloy product has a Cr content in a range of 0.04% to 0.3%.

5. The method according to claim 1, wherein the alloy product has a Ge content in a range of 0.08% to 0.35%.

6. The method according to claim 1, wherein the alloy product has a Ge content in a range of 0.3% to 0.35%.

7. The method according to claim 1, wherein the alloy product has a Cu content in a range of at least 1.1%.

8. The method according to claim 1, wherein the alloy product has a Mg content in a range of maximum 2.5%.

9. The method according to claim 6, wherein the alloy product has a Zn content in a range of 6.1% to 8.5%.

10. The method according to claim 1, wherein the alloy product has a Zn content in a range of 6.1% to 8.5%, wherein the alloy product has a Ge content in a range of 0.3% to 0.35%.

11. The method according to claim 1, wherein the alloy product has a Si content in a range of maximum 0.35%.

12. The method according to claim 6, wherein the alloy product has a thickness in a range of 2 inches (50 mm) to 12 inches (305 mm) at its thickest cross sectional point.

13. The method according to claim 1, the alloy product being a structural part of an aircraft.

14. The method according to claim 1, wherein the alloy product is a mould for manufacturing formed plastic products.

15. The method according to claim 1, wherein the alloy product has a final gauge of at least 2 inches (50 mm).

16. The method according to claim 1, wherein the alloy product has been hot rolled.

17. The method according to claim 1, wherein the alloy product has been extruded in an extrusion operation and is press-quenched.

18. The method according to claim 1, and wherein the cooled SHT stock is stretched or compressed or otherwise cold worked to relieve stresses by a member of the group consisting of levelling, drawing, and cold rolling of the cooled SHT stock.

19. The method according to claim 1, wherein

| | |
|---|---|
| Mn | at most 0.3%, |
| Ti | at most 0.1%, |
| Zr | 0.03% to 0.25%, |
| Cr | 0.04% to 0.2%, |
| Ge | 0.08% to 0.35%, |
| Cu | 1.1% to 2.2%, |
| Mg | at most 2.5%, |
| Zn | 6.4% to 8.1%, and |
| Si | at most 0.1%. |

20. The method according to claim 1, wherein

| | |
|---|---|
| Mn | 0.05% to 0.3%, |
| Ti | at most 0.1%, |
| Zr | 0.03% to 0.15%, |
| Cr | at most 0.2%, |
| Ge | about 0.3 to 0.35%, |
| Cu | 1.1% to 2%, |
| Mg | at most 1.9, |
| Zn | 6.4% to 8.1%, |
| Si | at most 0.25, |
| Fe | maximum 0.35%, |
| Zr | 0.03% to 0.2%, |

wherein the cooling of the SHT stock is in a furnace at the cooling rate of about 1-3° C. per minute to 150° C. or lower, wherein the heating temperature of step b. is heating is in a range of 510° C. to 535° C.

wherein the alloy product has a thickness in a range of 2 inches (50 mm) to 12 inches (305 mm) at its thickest cross sectional point.

21. The method according to claim 1, wherein the heating temperature of step b. is heating is in a range of 505° C. to 540° C.

22. The method according to claim 1, wherein the heating temperature of step b. is heating is in a range of 510° C. to 535° C.

23. The method according to claim 1, wherein the Li is included in the wrought aluminum alloy product.

* * * * *